US007920368B2

(12) United States Patent
Fujiwara et al.

(10) Patent No.: US 7,920,368 B2
(45) Date of Patent: Apr. 5, 2011

(54) STATIC ELIMINATOR

(75) Inventors: Nobuhiro Fujiwara, Tsukubamirai (JP); Noriaki Kusaba, Fukuoka (JP); Takashi Yasuoka, Tsukubamirai (JP); Satoshi Suzuki, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 564 days.

(21) Appl. No.: 11/993,502

(22) PCT Filed: Jun. 19, 2006

(86) PCT No.: PCT/JP2006/312215
§ 371 (c)(1),
(2), (4) Date: Feb. 1, 2008

(87) PCT Pub. No.: WO2006/137351
PCT Pub. Date: Dec. 28, 2006

(65) Prior Publication Data

US 2010/0073842 A1 Mar. 25, 2010

(30) Foreign Application Priority Data

Jun. 22, 2005 (JP) ..... 2005-182138

(51) Int. Cl.
*H01T 23/00* (2006.01)
*H05F 3/00* (2006.01)

(52) U.S. Cl. ..... 361/231

(58) Field of Classification Search ..... 361/230, 361/231
See application file for complete search history.

(56) References Cited

U.S. PATENT DOCUMENTS

| | | | | |
|---|---|---|---|---|
| 3,908,127 | A * | 9/1975 | Clark | 250/325 |
| 4,197,568 | A * | 4/1980 | Inowa et al. | 361/230 |
| 4,241,377 | A | 12/1980 | Cumming | |
| 4,792,680 | A * | 12/1988 | Lang et al. | 250/325 |
| 4,999,733 | A | 3/1991 | Kakuda | |
| 5,105,223 | A * | 4/1992 | Bergen | 399/171 |
| 6,252,233 | B1 | 6/2001 | Good | |
| 6,850,403 | B1 * | 2/2005 | Gefter et al. | 361/230 |
| 2005/0052815 | A1 | 3/2005 | Fujiwara et al. | |
| 2007/0097591 | A1 | 5/2007 | Fujiwara et al. | |
| 2007/0285871 | A1 | 12/2007 | Lee | |

FOREIGN PATENT DOCUMENTS

| | | |
|---|---|---|
| JP | 34-1729 | 12/1956 |
| JP | 63-80798 | 5/1988 |
| JP | 1 276595 | 11/1989 |
| JP | 3-188699 | 8/1991 |
| JP | 2002-25791 | 1/2002 |
| JP | 2003-86393 | 3/2003 |
| JP | 2004/205137 | 7/2004 |
| JP | 2004 205137 | 7/2004 |
| JP | 2004-349092 | 12/2004 |
| JP | 2005-108829 | 4/2005 |
| KR | 10-2004-0085091 | 10/2004 |

* cited by examiner

*Primary Examiner* — Ronald W Leja
(74) *Attorney, Agent, or Firm* — Oblon, Spivak, McClelland, Maier & Neustadt, L.L.P.

(57) ABSTRACT

A static eliminator that can be placed at a close distance capable of eliminating static electricity while preventing furious elevation of the surface electric potential of a work when the static eliminator is placed at a close distance to the work. A cover formed by an electro conductive porous material covering discharge needles is attached to a holding member in which a plurality of the discharge needles are provided and air blowing openings for ejecting air around the discharge needles are provided. The cover evenly discharges ionized air from the surface of the cover, and is electrically connected to ground to have a function for absorbing a part of generated ions.

12 Claims, 3 Drawing Sheets

STATIC ELIMINATOR

TECHNICAL FIELD

The present invention relates to a static eliminator for eliminating static electricity from a charged work, and in particular, to a static eliminator capable of eliminating static electricity under the state where the static eliminator is placed at a close distance to the work.

BACKGROUND ART

A static eliminator of a corona discharge system has been well known as a device for eliminating static electricity from a charged work. In particular, a static eliminator of a pulse DC system discharges a large amount of ions as compared with another system and is a system capable of generating ions by a plurality of discharge needles connected to a single high voltage generating circuit and has been often used for a static eliminator or the like of a bar type.

However, the static eliminator using a pulse DC system generates a large amount of ions, so that when the static eliminator is placed at a close distance (for example, not more than 100 mm) to a work which is a target for eliminating static electricity, an instantaneous surface electric potential of the work may be adversely elevated up to near 500 V with respect to the target 0 V as a large amount of ions are discharged to the work. Accordingly, when the static eliminator has to be placed at a close distance to a work, it is required to consider the elevation of the surface electric potential of the work.

In addition, a high voltage is applied to a discharge needle in pulse, so that when the static eliminator is placed at a close distance to a work, there is a problem in that the surface electric potential of the work is elevated by the dielectric effect of the discharge needle.

Further, ionized air is directly ejected toward a work from a nozzle in the conventional static eliminator, so that there is a problem in that unevenness of air flow speed, distribution unevenness of ions, or the like occurs between a position at which the nozzle exists and a position at which the nozzle does not exist and elimination of static electricity from a work is difficult to be uniformly performed.

DISCLOSURE OF INVENTION

Problems to be Solved by the Invention

A technical object of the present invention is to provide a static eliminator capable of eliminating static electricity without furiously elevating the surface electric potential of the work even when the static eliminator is placed at a close distance to the work.

Another technical object of the present invention is to provide a static eliminator having high static elimination property which can prevent partial unevenness of air flow speed, distribution unevenness of ions, or the like of ionized air discharged toward a work and which can surely and evenly eliminating static electricity from the whole work by adjusting the discharge amount of ions.

A still another technical object of the present invention is to provide a static eliminator whose discharge needle is not exposed outside and which is excellent in safety.

Means for Solving the Problem

To solve the above problems, the present invention provides a static eliminator including an ion discharge head equipped with a plurality of discharge needles for discharging ions by corona discharge and an air blowing opening for ejecting air at a position close to the discharge needles, a high voltage generating circuit for applying a high voltage to the discharge needles, and a control circuit for controlling the high voltage generating circuit. The ion discharge head has a discharge needle cover formed by an electro conductive porous material covering the whole plurality of discharge needles, and configured so that discharge of ions is equalized over the whole ion discharge head by discharging ionized air to the outside through the discharge needle cover, and the discharge amount of ions is adjusted by absorbing a part of generated ions in the discharge needle cover.

The ion discharge amount is adjusted by the discharge needle cover in the static eliminator structured in this manner. As a result, furious elevation of the surface electric potential of the work is prevented even when the static eliminator is placed at a close distance to the work. Further, since the flow speed of the ionized air is uniformed over the whole ion discharge head by the discharge needle cover, occurrence of unevenness of air flow speed, distribution unevenness of ions, or the like is pretended, elimination of static electricity from the whole work can be evenly and surely performed, and high elimination property of static electricity can be provided. In addition, the whole discharge needles are covered with the discharge needle cover, so that a high safety can be provided.

It is preferable that a space is provided between the distal ends of the discharge needles and the discharge needle cover, and configured to spread air in the space to discharge the air from the whole discharge needle cover in the present invention.

Further, the ion discharge head has an elongated bar shape and has a plurality pairs of the discharge needles, each the pair is formed by a positive and a negative discharge needles, and these discharge needles are provided to align in the longitudinal direction of the head in the state where the positive and negative discharge needles are arranged in the width direction of the head, and a storage box is attached to one end of the ion discharge head in the longitudinal direction and a positive one and a negative one of the high voltage generating circuit and the control circuit are stored in the storage box in a preferable example of the present invention.

In this case, it is preferable that the discharge needle cover is formed by a member having a U character shape in cross section and extends along the whole length of the ion discharge head in the longitudinal direction, and the surface of the discharge needle cover forms a guide surface for turning a work having a film shape which is a target for eliminating static electricity, and the work which is a target for eliminating static electricity can be guided in a non contact state or a low friction contact state by the air ejected form the guide surface.

Further, it is preferable that the discharge needle cover is connected to the control circuit, and configured so that ion balance is to be adjusted by controlling the high voltage generating circuit by the control circuit based on the variation of the electric potential of the discharge needle cover generated by absorbing ions in the present invention.

ADVANTAGES

According to the static eliminator of the present invention described above in detail, elimination of static electricity from a work can be effectively and surly performed. Further, elimination of static electricity can be performed without furiously elevating the electric potential of the work surface even the static eliminator is placed at a close distance to the work.

REFERENCE NUMERALS

Figure 1:
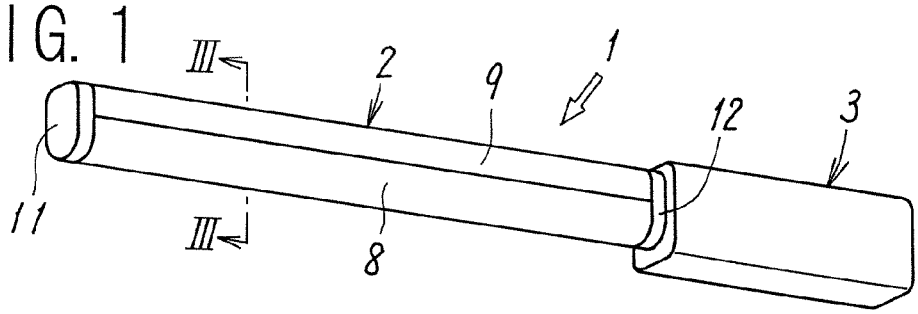
FIG. 1 is a perspective view showing an example of a static eliminator according to the present invention.

1 static eliminator
2 ion discharge head
3 storage box
4 holding member
4*a* lower surface
4*b* upper surface
5*a*, 5*b* discharge needle
6 air blowing opening
7 air flow path
8 discharge needle cover
8*a* side end wall
8*b* pore
9 upper cover
9*a* side end wall
10 space
11, 12 end plate
15 air flow path
16 connection port
17 air supply source
20*a*, 20*b* high voltage generating circuit
21 control circuit
22 MPU
23 self-excitation oscillating circuit
24 booster transformer
25 voltage doubler rectifier circuit
W work
R detection resistance

BEST MODE FOR CARRYING OUT THE INVENTION

Figure 6:
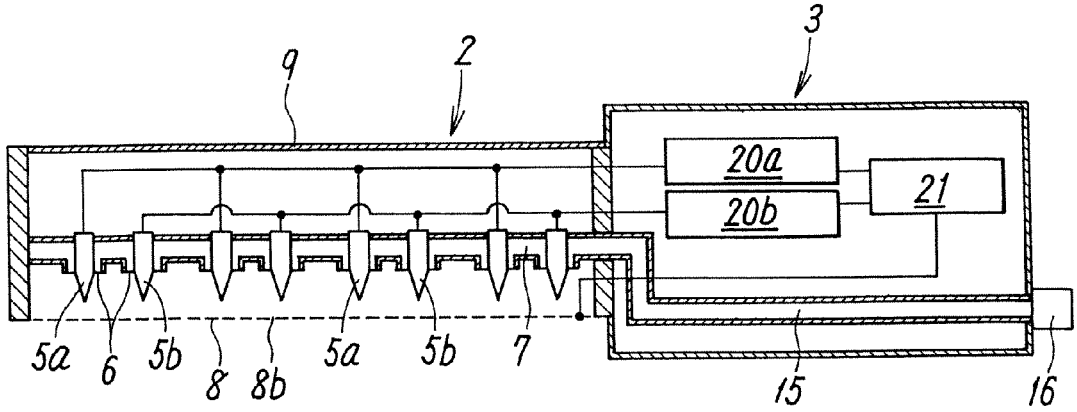
FIG. 6 is a cross sectional view schematically showing an electrical connection of the static eliminator according to the present invention.
Figure 7:
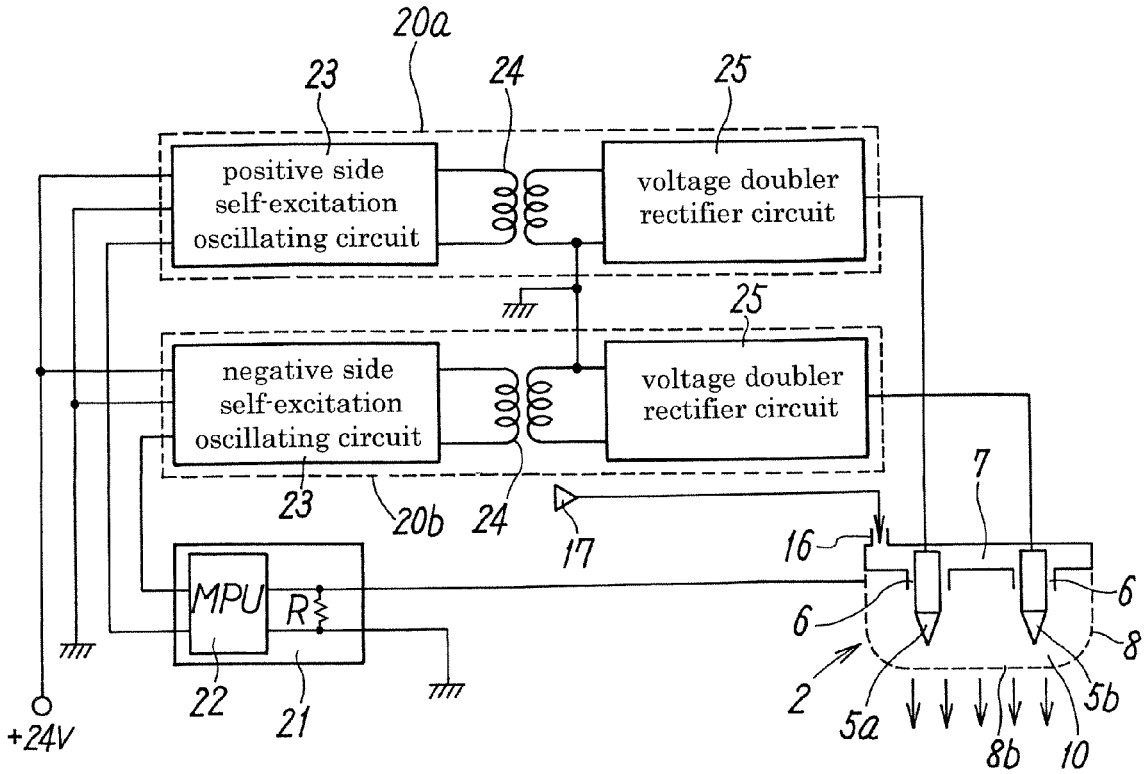
FIG. 7 is an electric circuit diagram of the static eliminator according to the present invention.

An embodiment of a static eliminator according to the present invention is shown by the drawings. The static eliminator 1 is a static eliminator of a pulse DC system and, as shown in FIGS. 1 to 4, is equipped with an ion discharge head 2 having an elongated bar shape and a storage box 3 attached at one end of the ion discharge head 2 in the longitudinal direction. Positive and negative discharge needles 5*a*, 5*b* for discharging ions by corona discharge are provided to the ion discharge head 2, and as shown in FIG. 6 and FIG. 7, positive and negative high voltage generating circuits 20*a*, 20*b* for applying a high voltage to the discharge needles 5*a*, 5*b* and a control circuit 21 for controlling the operation of the whole static eliminator 1 by controlling the positive and negative high voltage generating circuits 20*a*, 20*b* with a MPU are stored in the storage box 3.

Note that, in the description described below, the positive and negative discharge needles 5*a*, 5*b* shall be indicated by the common reference numeral "5" except when the positive and negative discharge needles 5*a*, 5*b* have to be distinctly described.

Figure 4:
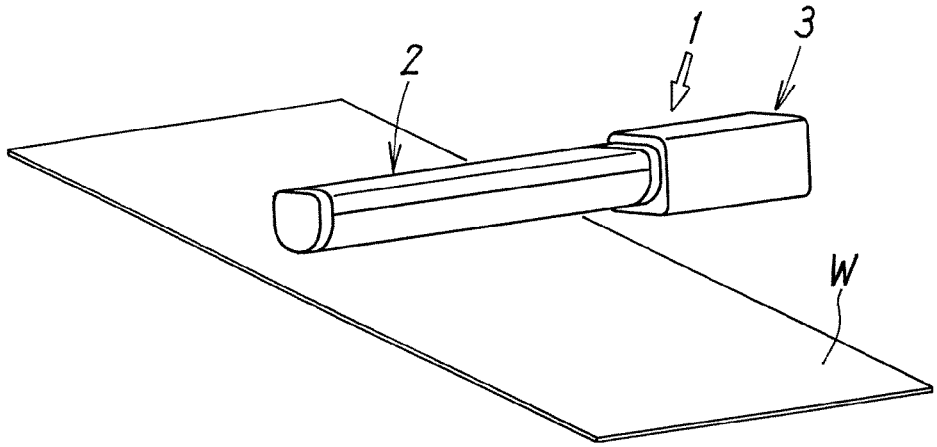
FIG. 4 is a perspective view showing an aspect in which static electricity of a flat work is eliminated by the static eliminator according to the present invention at a close position.

The ion discharge head 2 has a structure suited for eliminating static electricity from a work W placed at a close distance (for example, not more than 100 mm) as shown in FIG. 4. The ion discharge head 2 is equipped with a discharge needle holding member 4 formed by an insulating material such as a synthetic resin and having an elongated plate shape extending in the longitudinal direction of the head 2, a plurality of the discharge needles 5 whose proximal portions are held by the holding member 4 and whose needlepoints are projecting downwardly from the lower surface 4*a* of the holding member 4, a discharge needle cover 8 having a U character shape in cross section attached to the lower surface 4*a* of the holding member 4 and totally covering the discharge needles 5 and formed by a conductive porous material, an upper cover 9 having a U character shape in cross section attached to the upper surface 4*b* of the holding member 4, and end plates 11, 12 attached to the both ends of the holding member 4 in the longitudinal direction and close the opened both ends of the discharge needle cover 8 and the upper cover 9.

The plurality of discharge needles 5 are provided as a plurality pairs of positive and negative discharge needles 5*a*, 5*b*. The plurality pairs of discharge needles are provided to align in the longitudinal direction of the holding member 4 in the state where the positive and negative discharge needles 5*a*, 5*b* are arranged in the width direction of the holding member 4. Accordingly, the positive discharge needles 5*a* and the negative discharge needles 5*b* form two rows parallel to each other.

Further, a plurality of air blowing openings 6 opened near the each discharge needles 5 and for ejecting air along the discharge needles 5, and air flow paths 7 extending inside the holding member in the longitudinal direction and communicating with the each air blowing opening 6 are provided in the holding member 4. In the example shown in the drawing, the air blowing openings 6 are provided to respectively surround each of the positive and negative discharge needles 5*a*, 5*b*, the two air flow paths 7, 7 are provided in parallel, and one of the air flow path 7 is communicated with all of the air blowing openings 6 at the positive discharge needles 5*a* side and the other air flow path 7 is communicated with all of the air blowing openings 6 at the negative discharge needles 5*b* side.

The air flow paths 7 are communicated with a connection port 16 provided at an end surface of the storage box 3 via air a flow path 15 in the storage box 3 and air having a predetermined pressure is supplied from an air supply source 17 connected to the connection port 16. Then, when air is ejected from the each air blowing opening 6 in the state where positive and negative ions are discharged from the discharge needles 5*a*, 5*b*, the air becomes ionized air by including ions and is passed though the porous discharge needle cover 8 to be ejected toward the work W.

The discharge needle cover 8 is formed by, for example, a metal sintered body and pores 8*b* for ejecting air is evenly distributed on the entire surface. The discharge needle cover 8 is attached to the holding member 4 in the state where a space 10 is interposed between with the distal ends of the discharge needles 5. By the structure, the ionized air ejected from the air blowing openings 6 around the discharge needles 5 is spread in the space 10 and the pressure is equalized over the entirety of the inside of the cover, and is to be uniformly discharged from the whole surface of the discharge needle cover 8. Further, when the ionized air is passed through the discharge needle cover 8, a part of the ions are absorbed by the conductive discharge needle cover 8, and the amount of the ions is adjusted.

As described above, the ionized air is evenly spread to the entirety of the ion discharge head 2 to be ejected at an even flow speed and a part of the ions are absorbed by the head. As a result, occurrence of partial unevenness of the flow speed, distribution unevenness of ions, or the like is prevented and the amount of ions is adjusted to the level by which the surface electronic potential of the work W is not furiously elevated.

Herein, the inner pressure of the discharge needle cover 8, that is, the inner pressure of the space 10 is not necessary to increase so much with respect to the atmosphere pressure which is the pressure of the outside of the cover. Air is to be relatively gently discharged toward the work W by keeping the inner pressure to a positive pressure somewhat higher than the atmosphere pressure.

Further, the space 10 is air purged by the air from the air blowing openings 6. Accordingly, contamination of the discharge needles 5 can be prevented by managing the quality of the air supplied through the air flow path 7 by, for example, supplying the air cleaned by an air filter or the like to the space 10. In addition, the discharge needles 5 are placed to the elongated holding member 4 and the whole discharge needles 5 are covered with the cover 8. Accordingly, safety is assured and freedom degree of the placement of the discharge needles 5 is improved.

Figure 2:
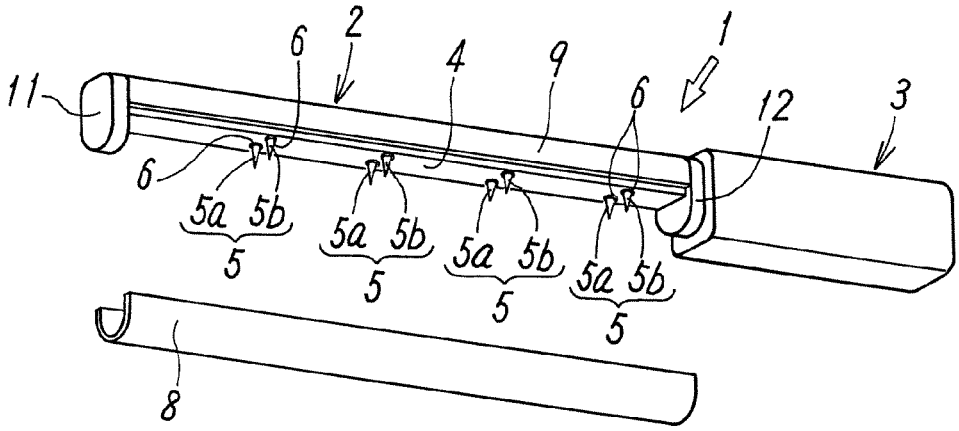
FIG. 2 is a perspective view showing a state where the cover of FIG. 1 is removed.
Figure 3:
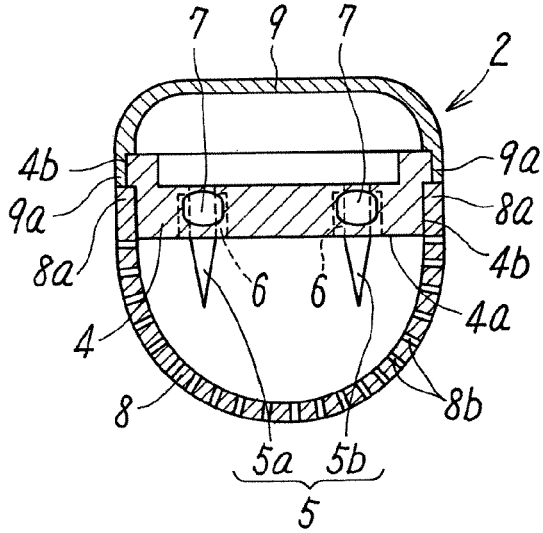
FIG. 3 is a cross sectional view taken along the line A-A of FIG. 1.

FIG. 6 and FIG. 7 show a cross sectional view and an electronic circuit diagram specifically showing electronic connections of the static eliminator 1. Note that, in FIG. 6, a plurality pairs of positive and negative discharge needles 5*a*, 5*b* are disposed on one row for the sake of convenience. However, the plurality pairs of positive and negative discharge needles 5*a*, 5*b* are provided in two rows as shown in FIG. 2 in actuality. As is understood from FIGS. 6 and 7, the both of the positive and negative high voltage generating circuits 20*a*, 20*b* stored in the storage box 3 are formed by a self-excitation oscillating circuit 23 and a voltage doubler rectifier circuit 25 connected to the self-excitation oscillating circuit 23 via a booster transformer 24. The positive high voltage generating circuits 20*a* is commonly connected to all of the positive discharge needles 5*a* and the negative high voltage generating circuits 20*b* is commonly connected to the all of the negative discharge needles 5*b*. Then, positive and negative pulse high voltages are alternatively applied to the positive and negative discharge needles 5*a*, 5*b*. Herewith positive and negative ions are alternatively discharged from the discharge needles 5*a*, 5*b*. At this time, the discharge needles placed at the side at which the pulse high voltage is not applied is connected to a circuit ground via the voltage doubler rectifier circuit 25.

Further, the discharge needle cover 8 may be formed by a conductive synthetic resin or the like other than the metal sintered body, and the discharge needle cover 8 is attached to the holding member 4 via sticking means as necessary. The pores 8*b* of the discharge needle cover 8 may linearly connect the internal and the external of the cover or may connect in a bent state. Further, the pores 8*b* may be regularly distributed or may be irregularly distributed to the whole cover.

On the other hand, the storage box 3, the end plats 11, 12, and the upper cover 9 can be formed by a synthetic resin.

Further, the discharge needle cover 8 is connected to the control circuit 21 and is electrically connected to a circuit ground via a detection resistance R in the control circuit 21, and an electric potential difference V of the both ends of the detection resistance R is to be input to the MPU 22. Then, the variation of the electric potential of the discharge needle cover 8 generated by absorbing the positive and negative ions alternatively discharged from the discharge needles 5*a*, 5*b* is detected by the control circuit 21 as the variation of the electric potential difference V of the both ends of the detection resistance R. Then, the generation amount of the ions is controlled by controlling the positive and negative high voltage generating circuits 20*a*, 20*b* based on the variation of the electric potential by the control circuit 21. In this manner, the ion balance is to be automatically controlled.

The discharge needle cover 8 and the upper cover 9 are freely attached to and detached from the holding member 4 by attaching the both side wall ends 8*a*, 9*a* extending in the longitudinal direction thereof to the side walls 4*b* of the holding member 4 by attaching means such as a spring or the like. However, at leas one of the covers may be fixed by using an adhesive bond. When the discharge needle cover 8 is freely attached and detached, the ionized air can be ejected far away when the discharge needle cover 8 is detached than when the discharge needle cover 8 is attached. This makes it possible to eliminate static electricity from a work placed at a relatively far place.

Herewith, the ion discharge amount is adjusted by the discharge needle cover 8 in the static eliminator 1 having the above structure. As a result, furious elevation of the surface electric potential of the work W is prevented even when the static eliminator 1 is placed at a close distance to the work W. Further, since the flow speed of the ionized air is uniformed over the whole ion discharge head 2 by the discharge needle cover 8, occurrence of unevenness of air flow speed, distribution unevenness of ions, or the like is pretended, elimination of static electricity from the whole work can be evenly and surely performed without causing occurrence of uneven elimination of static electricity, and high elimination property of static electricity can be provided. In addition, the whole discharge needles 5 are covered with the discharge needle cover 8, so that a high safety can be provided. Further, the furious elevation of the surface electric potential of the work caused by dielectric can be prevented by the discharge needle cover 8.

Figure 5:
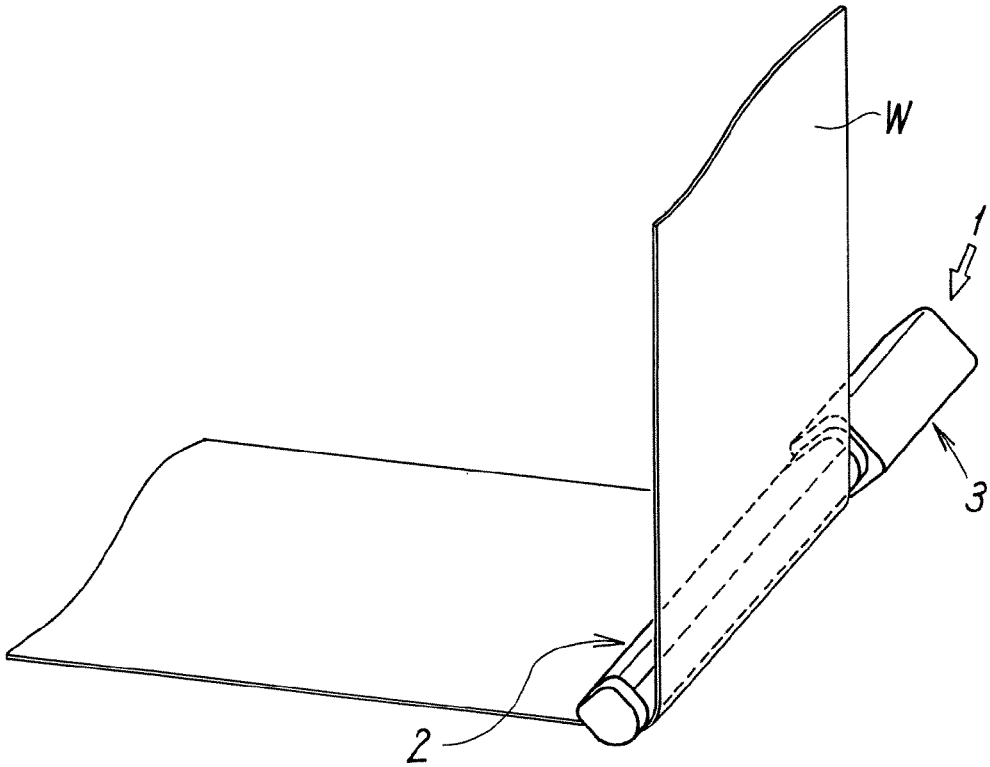
FIG. 5 is a perspective view showing an aspect in which static electricity of a work such as a continuous film or the like is eliminated by the static eliminator according to the present invention while turning the work.

An example when elimination of static electricity from the work W having a continuous film shape is performed by relatively moving the work W while turning the work W by the ion discharge head 2 is shown in FIG. 5. At this time, the work W is kept in a non contact state or a low friction contact state to the discharge cover 8 by intervention of the air ejected from the whole surface of the discharge needle cover 8. Accordingly, the ion discharge head 2 is equipped with a function as a direction turning guide for changing the direction of the work W.

Note that, when the static eliminator is used in this way, the surface of the discharge needle cover 8 is preferable to be formed to have smooth surface as mach as possible except providing the pores 8*b* for ejecting air.

The static eliminator of the present invention is not limited to the above embodiment and various modifications can be made without departing from the spirit of the invention.

For example, it is not necessary the case that the cross sectional shape of the holding member 4 is an approximately rectangular solid shape as long as the holding member 4 has an elongated structure by which a plurality pair of discharge needles can be held. Further, only a part at which the discharge needle 5 is set may be formed by an insulating material.

Further, it is not necessary the case that the upper cover 9 has a U character shape in cross section. Alternatively, the upper cover 9 may be eliminated.

The invention claimed is:

1. A static eliminator comprising:

an ion discharge head equipped with a plurality of discharge needles for discharging ions by corona discharge and a plurality of air blowing openings for ejecting air at a position close to the discharge needles;

a high voltage generating circuit for applying a high voltage to the discharge needles; and a control circuit for controlling the high voltage generating circuit, and wherein the ion discharge head has an elongated bar shape and a discharge needle cover formed by an electro conductive porous material covering the whole plurality of discharge needles and the whole plurality of air blowing openings, wherein the discharge needle cover is formed by a member having a U character shape in cross section, and has pores for ejecting air on the entire surface, and wherein the ion discharge head is configured so that discharge of ions is equalized over the whole ion discharge head by discharging ionized air to the outside through the discharge needle cover, and the discharge amount of ions is adjusted by absorbing a part of generated ions in the discharge needle cover.

2. The static eliminator according to claim 1, wherein a space is provided between the distal ends of the discharge needles and the discharge needle cover, and configured to spread air in the space to discharge the air from the whole discharge needle cover.

3. The static eliminator according to claim 1, wherein the ion discharge head has a plurality pairs of the discharge needles, each pair is formed by a positive and a negative discharge needle, and these discharge needles are provided to align in the longitudinal direction of the head in the state where the positive and negative discharge needles are arranged in the width direction of the head, and a storage box is attached to one end of the ion discharge head in the longitudinal direction and a positive one and a negative one of the high voltage generating circuit and the control circuit are stored in the storage box.

4. The static eliminator according to claim 2, wherein the ion discharge head has a plurality of pairs of the discharge needles, each pair is formed by a positive and a negative discharge needle, and these discharge needles are provided to align in the longitudinal direction of the head in the state where the positive and negative discharge needles are arranged in the width direction of the head, and a storage box is attached to one end of the ion discharge head in the longitudinal direction and a positive one and a negative one of the high voltage generating circuit and the control circuit are stored in the storage box.

5. The static eliminator according to claim 3, wherein the discharge needle cover extends along the whole length of the ion discharge head in the longitudinal direction, and the surface of the discharge needle cover forms a guide surface for turning a work having a film shape which is a target for eliminating static electricity, and the work which is a target for eliminating static electricity can be guided in a non contact state or a low friction contact state by the air ejected form the guide surface.

6. The static eliminator according to claim 4, wherein the discharge needle cover extends along the whole length of the ion discharge head in the longitudinal direction, and the surface of the discharge needle cover forms a guide surface for turning a work having a film shape which is a target for eliminating static electricity, and the work which is a target for eliminating static electricity can be guided in a non contact state or a low friction contact state by the air ejected form the guide surface.

7. The static eliminator according to claim 1, wherein the control circuit is connected to detect the electric potential of the discharge needle cover generated by absorbing ions and is configured to adjust the ion balance by controlling the high voltage generating circuit based on the variation of the electric potential of the discharge needle cover.

8. The static eliminator according to claim 2, wherein the control circuit is connected to detect the electric potential of the discharge needle cover generated by absorbing ions and is configured to adjust the ion balance by controlling the high voltage generating circuit based on the variation of the electric potential of the discharge needle cover.

9. The static eliminator according to claim 3, wherein the control circuit is connected to detect the electric potential of the discharge needle cover generated by absorbing ions and is configured to adjust the ion balance by controlling the high voltage generating circuit based on the variation of the electric potential of the discharge needle cover.

10. The static eliminator according to claim 4, wherein the control circuit is connected to detect the electric potential of the discharge needle cover generated by absorbing ions and is configured to adjust the ion balance by controlling the high voltage generating circuit based on the variation of the electric potential of the discharge needle cover.

11. The static eliminator according to claim 5, wherein the control circuit is connected to detect the electric potential of the discharge needle cover generated by absorbing ions and is configured to adjust the ion balance by controlling the high voltage generating circuit based on the variation of the electric potential of the discharge needle cover.

12. The static eliminator according to claim 6, wherein the control circuit is connected to detect the electric potential of the discharge needle cover generated by absorbing ions and is configured to adjust the ion balance by controlling the high voltage generating circuit based on the variation of the electric potential of the discharge needle cover.

* * * * *